US012577948B1

(12) United States Patent
Denfeld et al.

(10) Patent No.: US 12,577,948 B1
(45) Date of Patent: Mar. 17, 2026

(54) DEVICE FOR TRANSPORTING A LIQUID

(71) Applicant: HANON SYSTEMS EFP DEUTSCHLAND GMBH, Bad Homburg v.d. Höhe (DE)

(72) Inventors: Bernd Denfeld, Bad Homburg (DE); Tilo Schäfer, Daubach (DE); Lars Gerats, Bad Homburg (DE); Markus Münch, Wiesbaden (DE); Ante Bodrozic, Frankfurt (DE)

(73) Assignee: HANON SYSTEMS EFP DEUTSCHLAND GMBH, Bad Homburg V.S. Höhe (DE)

( * ) Notice: Subject to any disclaimer, the term of this patent is extended or adjusted under 35 U.S.C. 154(b) by 0 days.

(21) Appl. No.: 18/710,110

(22) PCT Filed: Apr. 3, 2023

(86) PCT No.: PCT/DE2023/100253

§ 371 (c)(1),
(2) Date: Oct. 29, 2024

(87) PCT Pub. No.: WO2023/198247

PCT Pub. Date: Oct. 19, 2023

(30) Foreign Application Priority Data

Apr. 12, 2022 (DE) ..... 10 2022 108 852.9

(51) Int. Cl.

| | |
|---|---|
| ***F04C 2/10*** | (2006.01) |
| ***F01M 1/02*** | (2006.01) |
| ***F01P 5/10*** | (2006.01) |
| ***F04C 15/00*** | (2006.01) |

(52) U.S. Cl.

CPC ..... *F04C 2/102* (2013.01); *F01M 1/02* (2013.01); *F01P 5/10* (2013.01); *F04C 15/008* (2013.01); *F01M 2001/0215* (2013.01); *F01M 2001/0238* (2013.01); *F04C 2240/51* (2013.01)

(58) Field of Classification Search

CPC .... F04C 2/102; F04C 11/008; F04C 15/0046; F04C 15/008; F04C 2240/51; F01M 1/02; F01M 2001/0215; F01M 2001/0238; F01P 5/10

See application file for complete search history.

(56) References Cited

U.S. PATENT DOCUMENTS

| | | | | |
|---|---|---|---|---|
| 2005/0265860 | A1 | 12/2005 | Kameya et al. | |
| 2011/0135516 | A1 | 6/2011 | Oishi et al. | |
| 2019/0055942 | A1 | 2/2019 | Scamarcio | |
| 2020/0088191 | A1 * | 3/2020 | Schaefer | F04C 29/047 |

FOREIGN PATENT DOCUMENTS

| | | | |
|---|---|---|---|
| DE | 102019200560 | A1 | 3/2020 |
| DE | 102019106255 | A1 | 9/2020 |
| JP | 2011117369 | A | 6/2011 |

* cited by examiner

*Primary Examiner* — Loren C Edwards
(74) *Attorney, Agent, or Firm* — Shumaker, Loop & Kendrick, LLP; James D. Miller

(57) ABSTRACT

A device for transporting a liquid, in particular a gerotor pump. The device has a housing with a flange which enclose a volume, an outer rotor mounted for rotation about a longitudinal axis and an inner rotor of a displacement mechanism, and a rotor of an electric drive. The rotor of the electric drive is formed integrally with the outer rotor. In addition, the flange is formed integrally with an eccenter for receiving the inner rotor and with a peg-shaped bearing element extending in the direction of the longitudinal axis for receiving the outer rotor.

14 Claims, 5 Drawing Sheets

DEVICE FOR TRANSPORTING A LIQUID

CROSS REFERENCE TO RELATED PATENT APPLICATIONS

This is a U.S. national phase patent application of PCT/DE2023/100253 filed Apr. 3, 2023 which claims the benefit of and priority to German Patent Application No. 10 2022 108 852.9 filed on Apr. 12, 2022, the entire contents of each of which are incorporated herein by reference.

TECHNICAL FIELD

The invention relates to a device for transporting a liquid, in particular a gear pump, specifically an annular gear pump or gerotor pump. The device has a housing, which encloses a volume and has a flange, an outer rotor mounted for rotation about a longitudinal axis and an inner rotor of a displacement mechanism, and a rotor of an electric drive. The rotor of the electric drive is integrally formed with the outer rotor of the displacement mechanism. The device is preferably used in a motor vehicle, in particular for lubricating and cooling a gear with an oil as the liquid.

BACKGROUND

Gear pumps known from the prior art, in particular annular gear pumps, also referred to as gerotor pumps, have an inner rotor and an outer rotor. The outer rotor can be formed integrally connected to a rotor of an electric drive, specifically an electric motor. The rotors are arranged inside a housing which is closed with a flange. The rotor of the electric motor and the outer rotor of the displacement mechanism of the gerotor pump are fixed to a rotatably mounted shaft.

The shaft is supported on the flange via a bearing. The shaft is mounted in the region of the flange inside an opening which is provided in an eccenter and faces in an axial direction. The eccenter is formed integrally with the flange as a part of the flange. The inner rotor is guided, driven by the outer rotor, on an outer side of the eccenter. A liquid is transported from a suction region or an inlet to a pressure region or an outlet into intermediate spaces, also referred to as gerotor cells, provided between the outer rotor and the inner rotor.

DE 10 2019 200 560 A1 discloses a gerotor pump of this type with a separately formed shaft of the rotor of the electric motor and thus of the outer rotor of the displacement mechanism. The shaft is designed as a hollow shaft having a through opening facing in an axial direction as a device for pressure equalization. The pressure equalization is then ensured between a motor space as a region of the volume which is enclosed by the housing and in which the rotor of the electric motor is arranged, and the suction region formed inside the flange.

The liquid, for example a lubricating oil of a gear, flows as a leakage flow from the motor space through the through opening formed in the hollow shaft with a plate to minimize leakage, to the suction region. As well as pressure equalization, the leakage flow is also used to cool a control unit of the gerotor pump, for example.

The bearing of the hollow shaft inside the opening, facing in an axial direction, of the flange and the bearing of the inner rotor on the outer side of the eccenter as a part of the flange require a certain wall thickness of the eccenter between the inner side and the outer side of the eccenter in order to ensure sufficient strength of the flange. In addition, the minimum outer diameter of the shaft is limited by the inner diameter of the through opening formed in the shaft.

The necessary wall thickness of the eccenter and the necessary inner diameter of the through opening formed in the shaft result in a limited minimum diameter of the contour, in particular a limited root diameter, of the inner rotor, which in turn limits the possible transport volume of the gerotor pump with the same installation space. Consequently, the transport volume of the gerotor pump can be increased while keeping the number of gerotor cells the same only by enlarging the outer diameter of the outer rotor and thus the housing. In this case, however, the installation space of the gerotor pump would be increased.

SUMMARY

The object of the invention consists in providing a device for transporting a liquid, in particular a gerotor pump, having a theoretical transport volume greater than devices known from the prior art but with an unchanged or reduced required installation space. The device should be simple to produce and able to be assembled in a time-saving manner.

The object is achieved by the subjects having the features shown and described herein.

The object is achieved by a device according to the invention for transporting a liquid, in particular a gerotor pump. The device has a housing with a flange which together enclose a volume, an outer rotor mounted for rotation about a longitudinal axis and an inner rotor of a displacement mechanism, and a rotor of an electric drive. The rotor of the electric drive is integrally formed with the outer rotor of the displacement mechanism.

According to the concept of the invention, the flange has an eccenter for receiving the inner rotor and a peg-shaped bearing element extending in the direction of the longitudinal axis for receiving the outer rotor. According to the invention, the flange is integrally formed with the eccenter and the bearing element.

Whereas the outer rotor is mounted for rotation about the bearing element and the longitudinal axis, the inner rotor is arranged for rotation about the eccenter inside the outer rotor. The rotor of the electric drive is held together with the outer rotor of the displacement mechanism directly on the peg-shaped bearing element, oriented in the direction of the longitudinal axis, of the flange, for rotation about the longitudinal axis.

With the integral formation of the flange, the eccenter and the bearing element, the bearing element is arranged fixedly, immovably and rigidly and thus non-rotationally in relation to the housing or the flange. An integral formation means for example a formation from only one element such as a single-part cast element. However, an integral formation can also include a formation from multiple elements which are fixedly connected to one another, in particular pressed to one another.

The bearing element is preferably at least substantially cylinder-shaped with a constant outer diameter in the direction of the longitudinal axis.

In addition, the bearing element advantageously protrudes from a free end face of the eccenter facing in the direction of the housing. If the housing is formed with a substantially hollow, circular cylindrical shape with a first closed end face, the flange closes a second end face of the housing formed distally from the first end face.

According to a development of the invention, the bearing element has, on a lateral surface, a first bearing surface for guiding the rotor of the electric drive with the outer rotor. A second bearing surface for guiding the inner rotor driven by the outer rotor is preferably provided on an outer side of the eccenter.

According to an advantageous embodiment of the invention, a fluidic connection of a device for pressure equalization is formed between a motor space as a region of the volume enclosed by the housing with the flange and a suction region. In this case, the motor space constitutes a first part of the volume enclosed by the housing in combination with the flange, while the outer rotor and the inner rotor of the displacement mechanism are arranged in a second part of the volume.

According to a first alternative embodiment of the invention, the flange has an axial through opening as a part of the device for pressure equalization, at least in the region of the bearing element and the eccenter. The through opening preferably extends starting from a first, free end face in the axial direction into the bearing element. The through opening is advantageously oriented coaxially with the longitudinal axis of the device. The through opening can be formed with a throttle device for the liquid.

The flange can have a flattened region in the region of the cylinder-shaped eccenter. The flattened region is then formed on an outer lateral surface of the eccenter.

According to a second alternative embodiment of the invention, the flange has a respective flattened region in the region of the cylinder-shaped bearing element and in the region of the cylinder-shaped eccenter. The flattened region is respectively formed on an outer lateral surface.

In this case, a first flattened region extends in the axial direction over the full length of the eccenter, starting from the first, free end face to a second end face of the eccenter at which the eccenter merges into the region of the flange closing the housing. With the first flattened region, a flow path is produced between the eccenter and an inner side of the inner rotor of the displacement mechanism.

The flange is preferably formed with a groove running in the radial direction which extends between the first flattened region and the suction region of the device.

A further advantage of the invention consists in that a second flattened region extends in the axial direction, starting from the first, free end face to a second end face of the bearing element. On the second end face, the bearing element is connected to the eccenter on the end face of the eccenter facing in the direction of the housing. With the second flattened region, a flow path is produced between the bearing element and an inner side of the rotor of the electric drive.

The second flattened region can extend in the axial direction continuously over the full length of the bearing element.

Alternatively, the second flattened region can be formed from at least two sections extending in the axial direction respectively over a partial length of the bearing element. In this case, the at least two sections of the second flattened region are preferably arranged on the bearing element opposite to one another in the radial direction and offset from one another in the axial direction.

With the flattened regions as slants or chamfers each formed on the outer diameter of the cylinder-shaped bearing surfaces, and the groove, a flow path is provided in each case as a cohesive leakage path for the liquid. With an adaptation of the flow cross section between the chamfer and the bearing surface or the groove, a throttle function can also be realized.

The advantageous design of the invention allows the use of the device for transporting a liquid in a motor vehicle, in particular for lubricating and cooling a gear with an oil as a liquid or for cooling a battery or an electric motor.

In summary, the device according to the invention has further diverse advantages:

- greater transport volume with the same or a smaller installation space in comparison with devices known from the prior art, or the same transport volume with a smaller installation space,
- minimal number of components, since, for example, the separately formed shaft for guiding the rotor of the electric drive or the outer rotor is no longer necessary in comparison with devices from the prior art, and as a result
- minimal production and assembly costs.

BRIEF DESCRIPTION OF THE DRAWINGS

Further details, features and advantages of embodiments of the invention can be found in the description of exemplary embodiments below with reference to the associated drawings. In the drawings.

DESCRIPTION OF AN EMBODIMENT

Figure 1B:
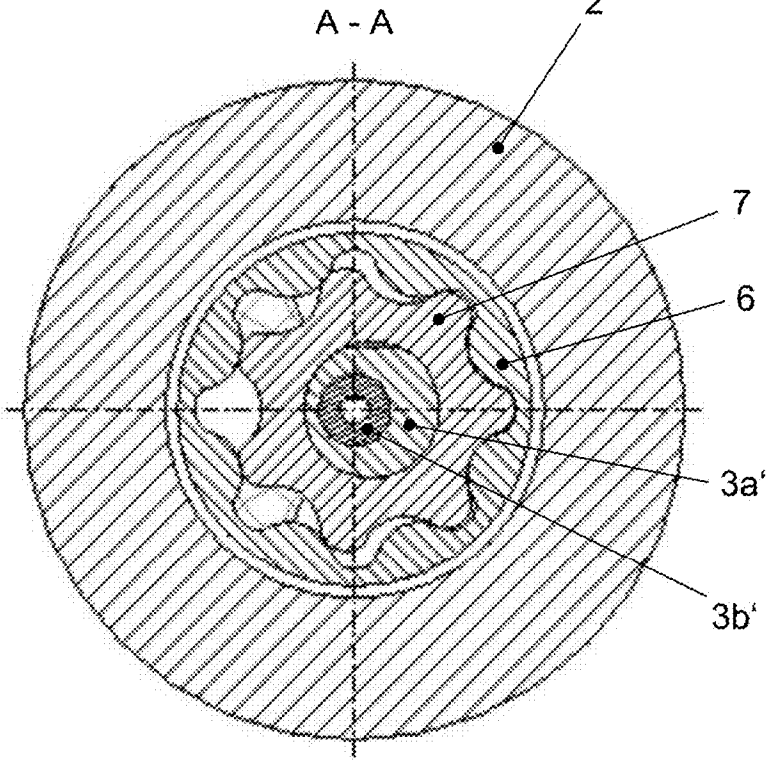
PRIOR ART FIG. 1B
FIGS. 1A and 1B: show a gerotor pump with a housing closed by a flange, an outer rotor arranged on a rotatably mounted shaft, and an inner rotor, and a device for pressure equalization between a suction region and a motor space from the prior art, in a sectional diagram from the side and a sectional diagram from above.
Figure 1A:
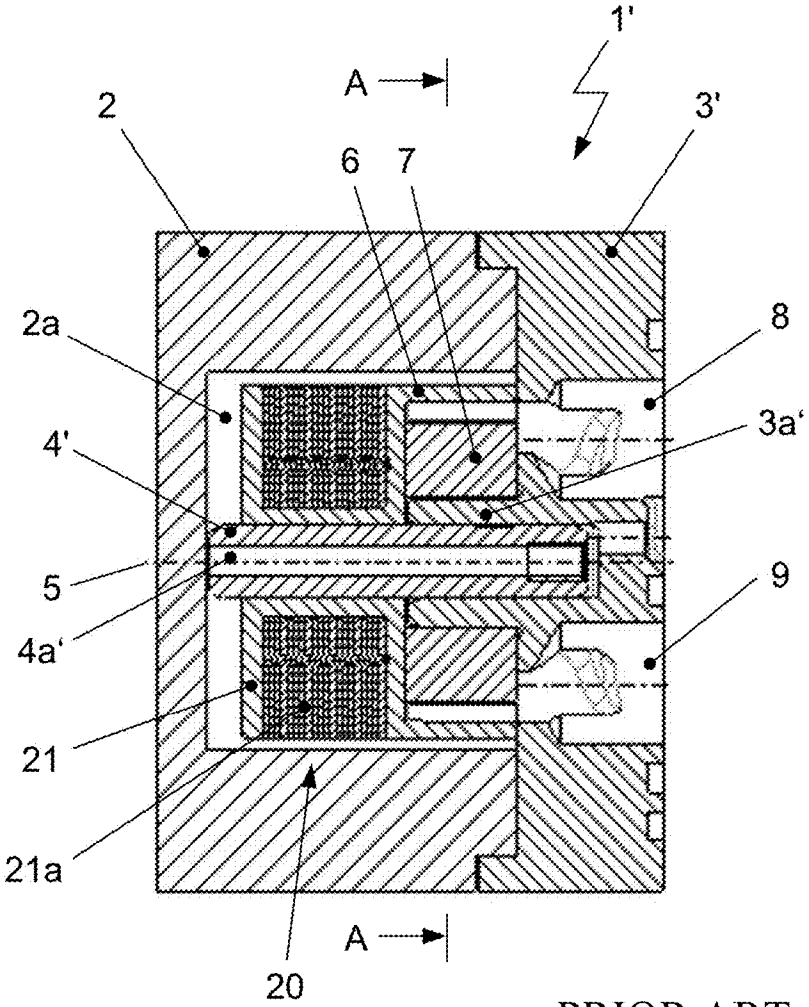
PRIOR ART FIG. 1A

FIGS. 1A and 1B show a device 1' for transporting a liquid, in particular a gerotor pump, from the prior art in a sectional diagram from the side and a sectional diagram from above. The device 1' is formed with a housing 2 closed by a flange 3', an outer rotor 6 arranged on a rotatably mounted shaft 4', and an inner rotor 7, and a device for pressure equalization between a motor space 2*a* and a suction region 8.

The substantially hollow circular cylinder-shaped housing 2 has a first closed end face. A second end face formed distally from the first end face is closed by means of the flange 3'. The motor space 2*a* constitutes a first part of the volume enclosed by the housing 2 in combination with the flange 3', while the outer rotor 6 and the inner rotor 7 of the displacement mechanism are arranged in a second part of the volume. Both parts together form the volume enclosed by the housing 2.

A rotor 21 of an electric motor 20 with rotor laminations 21*a* is arranged inside the motor space 2*a* of the housing 2. A stator (not shown) of the electric motor 20 has a stator lamination stack with coil windings, which are embedded together with the stator lamination stack in a plastic. The plastic, which is moulded using an injection-moulding method, for example, forms the housing 2. The stator and the rotor 21 of the electric motor 20 extend along a common longitudinal axis 5, which constitutes the rotational axis of the rotor 21. The stator is positioned on an outer side of the rotor 21 in the radial direction, enclosing the rotor. The flange 3' can likewise be formed from a plastic, preferably from the same plastic as the housing 2, or from a metal.

The rotor laminations 21*a* together with permanent magnets (not shown) are overmoulded with a plastic such that the rotor 21 of the electric motor 20 is formed integrally with the outer rotor 6 of the displacement mechanism. Consequently, the plastic forms both the rotor 21 of the electric motor 20 and the outer rotor 6 of the displacement mechanism in such a way that the outer rotor 6 is driven directly by the rotor 21 of the electric motor 20.

The rotor 21 of the electric motor 20 together with the outer rotor 6 of the displacement mechanism is connected to the shaft 4' mounted for rotation about the longitudinal axis 5. The shaft 4' is supported on the housing 2 on one side and on the flange 3' on the other side via a bearing in each case. The shaft 4' is mounted in the axial direction on the housing 2, in the radial and axial directions on the flange 3', and in the region of the flange 3' inside a receiving opening 3*b*' facing in an axial direction. The receiving opening 3*b*' is provided in a region of the flange 3' formed as an eccenter 3*a*'. The eccenter 3*a*' is formed integrally with the flange 3' as a part of the flange 3'.

The inner rotor 7, driven by the outer rotor 6, of the displacement mechanism is mounted on an outer side of the eccenter 3*a*' independently of the outer rotor 6 so that the inner rotor 7 is arranged eccentrically to the shaft 4' and to the outer rotor 6. The liquid to be transported by the device 1' is guided into intermediate spaces provided between the inner rotor 7 and the outer rotor 6 from the suction region 8 as an inlet of the device 1' to a pressure region 9 as an outlet of the device 1'. The liquid is brought by the device 1' from a low pressure at the inlet to a higher pressure at the outlet.

Owing to an inflow of the liquid through a gap remaining between the outer rotor 6 and the flange 3' from the pressure region 9 into the motor space 2*a* of the device 1', liquid is applied to the motor space 2*a* at an intermediate pressure level. As a result of the intermediate pressure prevailing in the motor space 2*a*, the gap remaining between the outer rotor 6 and the flange 3' is reduced, and thus the sealing effect of the outer rotor 6 on the flange 3' is increased. The intermediate pressure level represents a pressure level between the pressure levels of the liquid in the suction region 8 and in the pressure region 9.

The shaft 4' is formed as a separate element and as a hollow shaft with a through opening 4*a*' pointing in the axial direction as a device for pressure equalization between the motor space 2*a* and the suction region 8. The liquid flowing into the motor space 2*a*, for example a lubricating oil of a gear, flows as a leakage flow from the motor space 2*a* through the through opening 4*a*' formed in the shaft 4' back to the suction region 8. The through opening 4*a*' can be formed with a throttle device for the liquid to minimize leakage.

With the leakage flow of the liquid through the motor space 2*a*, waste heat generated in the device 1', in particular by the electric motor 20, can be dissipated, for example. The leakage flow can also be used to lubricate the bearing of the shaft 4'.

Figure 2B:
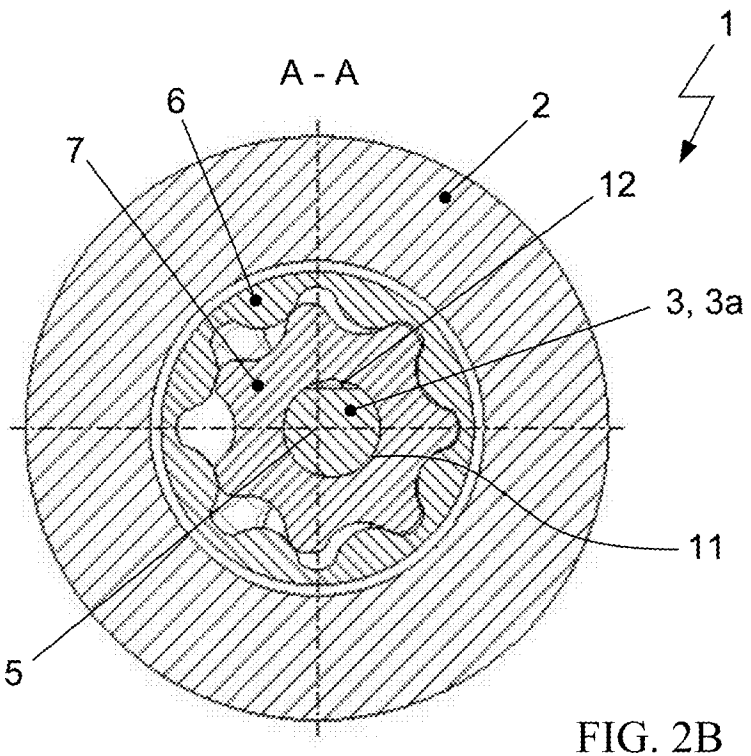
FIGS. 2A and 2B: show a gerotor pump with an arrangement of the outer rotor on a peg-shaped bearing element formed integrally with the flange, in a sectional diagram from the side and a sectional diagram from above.
Figure 2C:
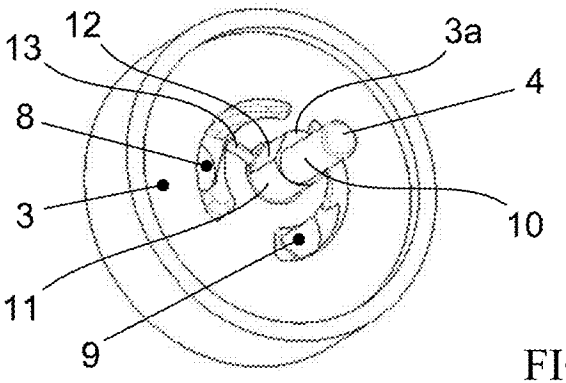
FIG. 2C: shows the flange, formed integrally with the bearing element for receiving the outer rotor, of the gerotor pump according to FIGS. 2A and 2B in a perspective view.
Figure 2A:
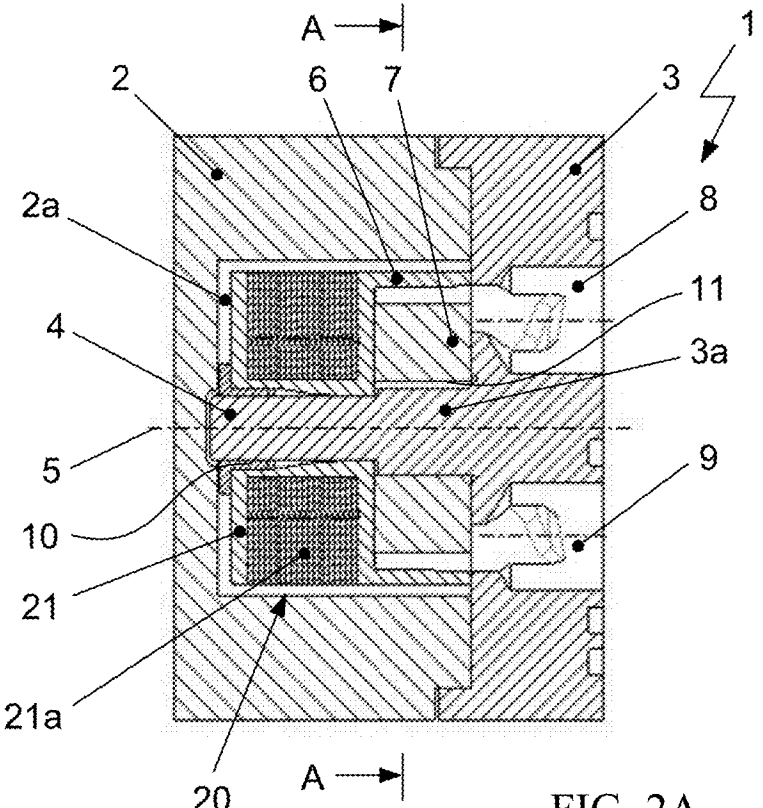

FIGS. 2A and 2B show a device 1 for transporting a liquid, in particular a gerotor pump, with an arrangement of the outer rotor 6 on a peg-shaped bearing element 4 formed integrally with the flange 3, in a sectional diagram from the side and a sectional diagram from above. FIG. 2C shows the flange 3, formed integrally with the bearing element 4 for receiving the outer rotor 6, of the device 1 according to FIGS. 2A and 2B in a perspective view.

Like components of the devices 1, l' are provided with the same reference signs. For the description of the functions of like components, reference is also made to the statements relating to the device 1' according to FIGS. 1A and 1B.

An essential difference between the device 1' according to FIGS. 1A and 1B from the prior art and the device 1 according to FIGS. 2A and 2B lies in the formation of the shaft 4' as a bearing element 4 in conjunction with the flange 3', 3. In comparison with the rotatable shaft 4' of the device 1', the bearing element 4 corresponds to a rigid, immovable and thus fixed shaft.

Therefore, the rotor 21 of the electric motor 20 of the device 1 together with the outer rotor 6 of the displacement mechanism is mounted for rotation about the longitudinal axis 5 on the peg-shaped bearing element 4 oriented in the direction of the longitudinal axis 5. Like the eccenter 3*a*, the rigid and thus non-rotational bearing element 4 is formed integrally with the flange 3 as a part of the flange 3. The rotor 21 of the electric motor 20 and the outer rotor 6 of the displacement mechanism are thus mounted directly on the flange 3, which can also be regarded as a component of the housing 2. The cylinder-shaped bearing element 4 has a constant outer diameter over the length in the direction of the longitudinal axis 5.

The integral formation of the flange 3 with the eccenter 3*a* and the peg-shaped bearing element 4 protruding from a free end face of the eccenter 3*a* facing in the direction of the housing 2 means that it is no longer necessary to mount the rotatable shaft 4', corresponding to the device 1' from FIGS. 1A and 1B, in the region of the flange 3' inside the receiving opening 3*b*' facing in the axial direction. Consequently, the flange 3 is formed without the receiving opening, which weakens the wall of the flange 3.

Instead of the receiving opening in the region of the flange 3 formed as an eccenter 3*a* for receiving the rotatable shaft, the bearing element 4 which is formed integrally with the flange 3 and is thus rigid has, on the lateral surface, a first bearing surface 10 for guiding the rotor 21 of the electric motor 20 with the outer rotor 6. A second bearing surface 11 for guiding the inner rotor 7, driven by the outer rotor 6, of the displacement mechanism is formed on the outer side of the eccenter 3*a*.

The device 1 has a flattened region 12 of the cylinder-shaped eccenter 3*a* as a device for pressure equalization. The flattened region 12, which is provided on the outer lateral surface of the cylinder with an otherwise circular cross section, extends in the axial direction over the full length of the eccenter 3*a* and thus from a free end face facing in the direction of the housing 2 to a second end face of the eccenter 3*a*. At the second end face, the eccenter 3*a* merges into the region of the flange 3 which closes the housing 2. With the flattened region 12 of the eccenter 3*a*, a flow path is formed between the eccenter 3*a* and the inner side of the inner rotor 7.

In the region of the transition from the eccenter 3*a* to the region of the flange 3 closing the housing 2, the flange 3 is formed with a groove 13 running in the radial direction. The groove 13 connects the flow path formed between the eccenter 3*a* and the inner side of the inner rotor 7 to the suction region 8 of the device 1.

With the intermediate space formed between the eccenter 3*a* and the inner side of the inner rotor 7 by the flattened region 12 of the eccenter 3*a*, the groove 13, and the bearing play between the rotor 21 and the first bearing surface 10, which are fluidically connected to one another, the flow path for the leakage flow of the liquid from the motor space 2*a* to the suction region 8 is ensured. The throttle function is provided via the bearing play between the rotor 21 and the first bearing surface 10.

With the integration of the shaft as the bearing element 4 in the flange 3 and thus the omission of the receiving opening for supporting the rotatable shaft inside the flange, the outer diameter of the eccenter 3*a* as the bearing diameter of the inner rotor 7 of the device 1 is reduced in comparison with the device 1' from the prior art according to FIGS. 1A and 1B while the wall thickness of the inner rotor 7 remains the same, and/or the eccentricity of the device 1, in particular of the inner rotor 7, is increased.

A larger transport volume is thus made possible while the installation space of the device 1, in particular the outer diameter and the extent in the direction of the longitudinal axis, remains the same in comparison with the device 1' from the prior art. Alternatively, the installation space of the device 1 can be reduced while the transport volume remains the same.

Figure 3B:
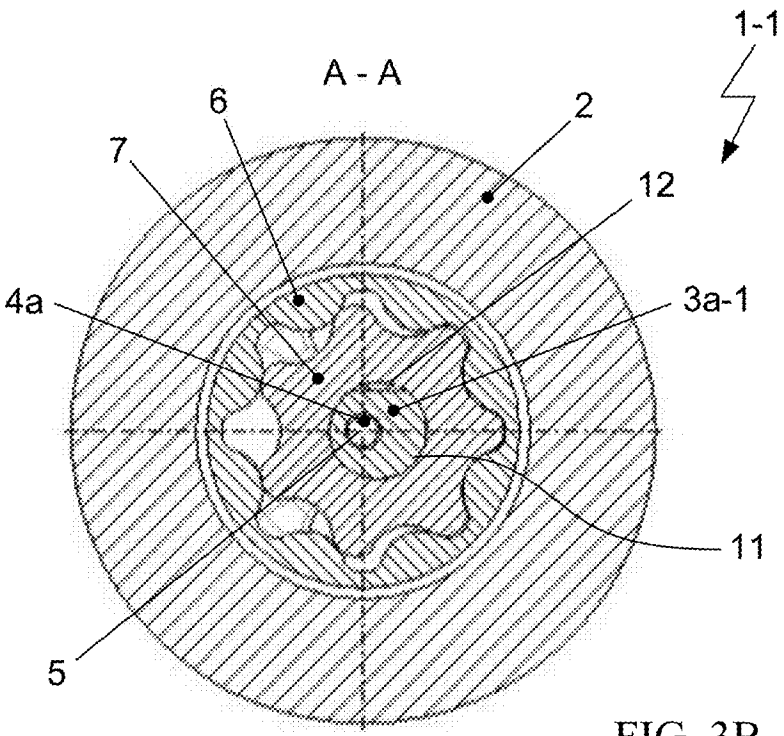
FIGS. 3A and 3B: show a first embodiment of a gerotor pump with the arrangement of the outer rotor on the peg-shaped bearing element formed integrally with the flange, with an axial through opening as the device for pressure equalization between the suction region and the motor space, in a sectional diagram from the side and a sectional diagram from above.
Figure 3C:
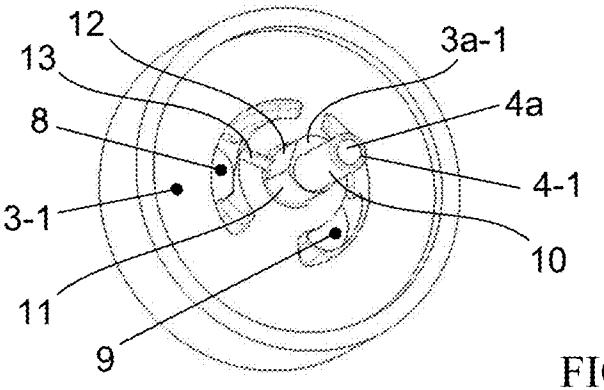
FIG. 3C: shows the flange of the gerotor pump according to FIGS. 3A and 3B in a perspective view.
Figure 3A:
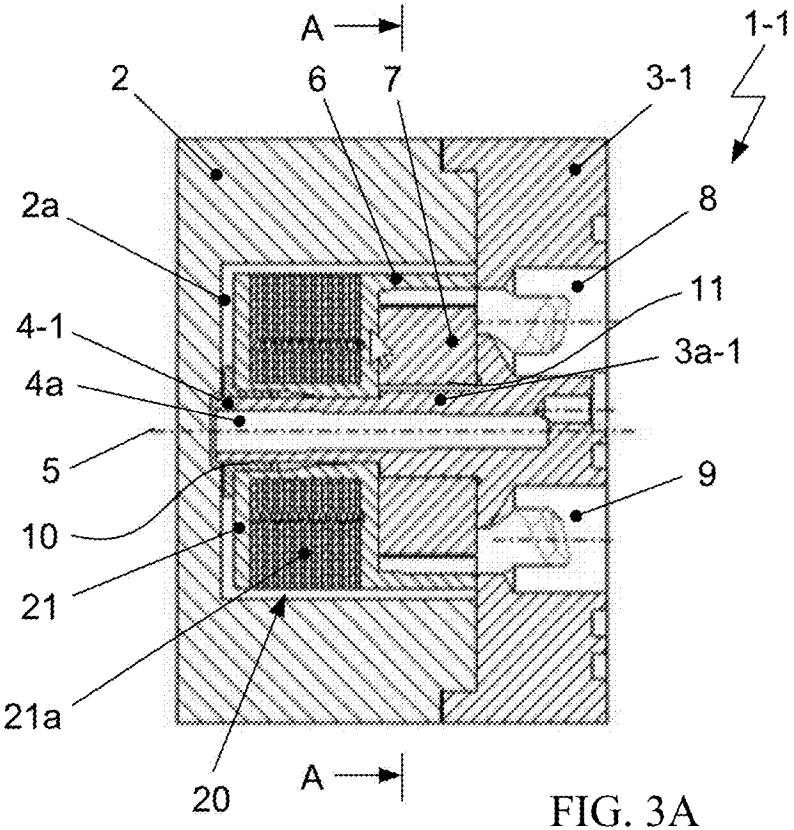

FIGS. 3A and 3B show a device 1-1 for transporting a liquid as a first embodiment of a gerotor pump with the arrangement of the outer rotor 6 on the peg-shaped bearing element 4-1 formed integrally with the flange 3-1, with an axial through opening 4*a* as the device for pressure equalization between the suction region 8 and the motor space 2*a*, in a sectional diagram from the side and a sectional diagram from above. FIG. 3C shows the flange 3-1, formed integrally with the bearing element 4-1 for receiving the outer rotor 6, of the device 1-1 according to FIGS. 3A and 3B in a perspective view.

Like components of the devices 1, 1-1 according to FIG. 2A to 2C are provided with the same reference signs. For the description of the functions of like components, reference is also made to the statements relating to the device 1 according to FIG. 2A to 2C.

An essential difference between the device 1 according to FIGS. 2A and 2B and the device 1-1 according to FIGS. 3A and 3B lies in the formation of the bearing element 4, 4-1 and of the flange 3, 3-1 with a through opening 4*a*.

The through opening 4*a* facing in the axial direction is formed coaxially with the longitudinal axis 5 as a device for pressure equalization between the motor space 2*a* and the suction region 8. The through opening 4*a* therefore constitutes a fluidic connection between the motor space 2*a* and the suction region 8 of the device 1-1, so that liquid flowing into the motor space 2*a*, in particular the lubricating oil of a gear, flows as a leakage flow from the motor space 2*a* through the through opening 4*a* back to the suction region 8. The through opening 4*a*, which extends from a first, free end face in the axial direction into the bearing element 4-1 and through the bearing element 4-1 and the eccenter 3*a*-1 of the flange 3-1, is formed with a throttle device for the liquid to minimize leakage. The through opening 4*a* opens into the motor space 2*a* in the region of the first end face of the bearing element 4-1. The intermediate space and groove 13, which are connected fluidically to one another and are formed between the eccenter 3*a*-1 and the inner side of the inner rotor 7 by the flattened region 12 of the eccenter 3*a*-1, are used for the lubrication, cooling or pressure relief of the bearing.

To increase the transport volume further while keeping the installation space of the device the same, or to reduce the installation space further while keeping the transport volume of the device the same, the diameter of the peg-shaped bearing element should be reduced.

Figure 4B:
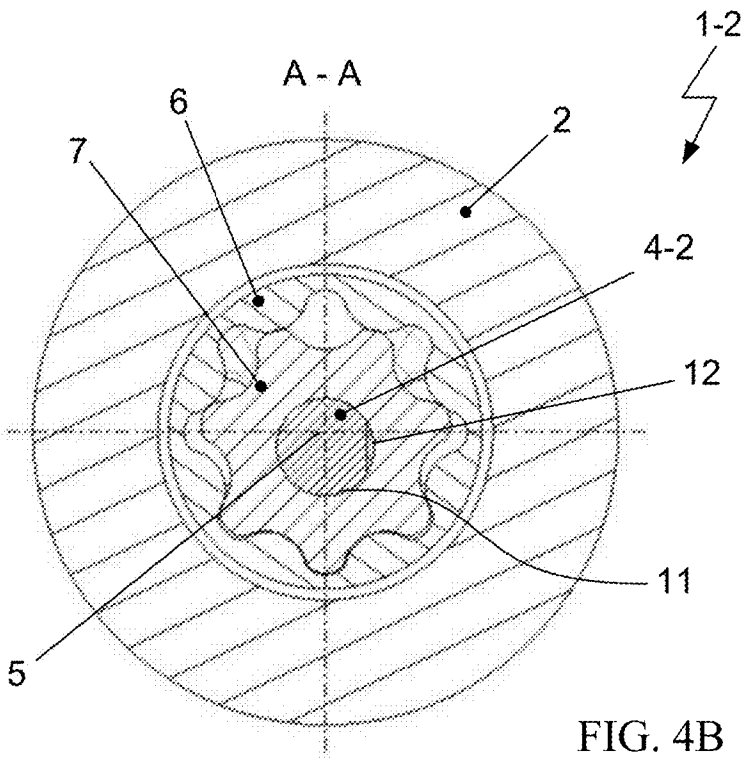
FIGS. 4A and 4B: show a second embodiment of a gerotor pump with the arrangement of the outer rotor on the peg-shaped bearing element formed integrally with the flange, with a flattened region as the device for pressure equalization between the suction region and the motor space, in a sectional diagram from the side and a sectional diagram from above.
Figure 4C:
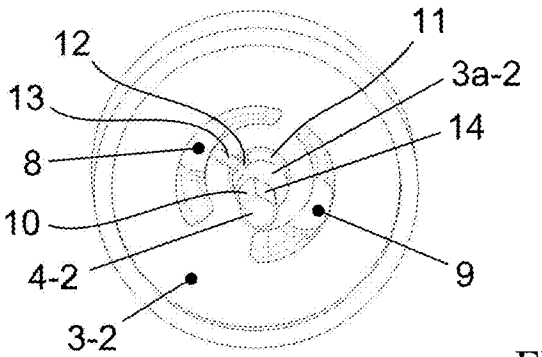
FIG. 4C: shows the flange of the gerotor pump according to FIGS. 4A and 4B in a perspective view.
Figure 4A:
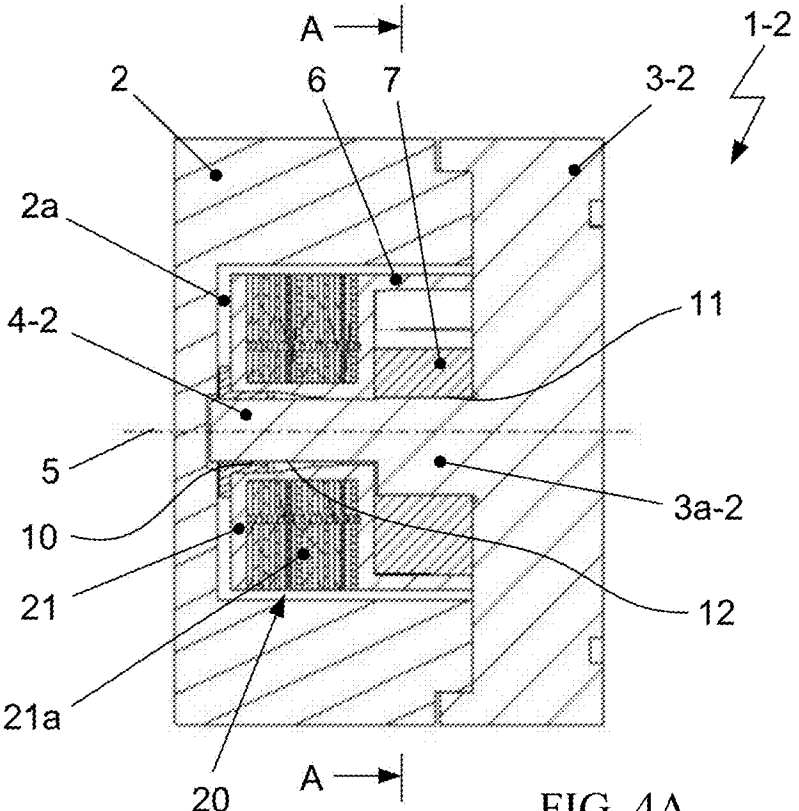

FIGS. 4A and 4B show a device 1-2 for transporting a liquid as a second embodiment of a gerotor pump with the arrangement of the outer rotor 6 on the peg-shaped bearing element 4-2 formed integrally with the flange 3-2, with a flattened region 14 as a section of a device for pressure equalization between the suction region 8 and the motor space 2*a*, in a sectional diagram from the side and a sectional diagram from above. FIG. 4C shows the flange 3-2, formed integrally with the bearing element 4-2 for receiving the outer rotor 6, of the device 1-2 according to FIGS. 4A and 4B in a perspective view.

Like components of the devices 1, 1-1, 1-2 are again provided with the same reference signs. For the description of the functions of like components, reference is also made to the statements relating to the device 1 according to FIG. 2A to 2C.

An essential difference between the devices 1, 1-1, 1-2 lies in the formation of the bearing element 4, 4-1, 4-2 and of the flange 3, 3-1, 3-2 with regard to the device for pressure equalization between the motor space 2*a* and the suction region 8.

The device 1-2 from FIGS. 4A and 4B has a respective flattened region 12, 14 on the cylinder-shaped bearing element 4-2 and on the cylinder-shaped eccenter 3*a*-2 as the device for pressure equalization. The flattened regions 12, 14 are each provided on the outer lateral surface of the cylinder with an otherwise circular cross section. In comparison with the device 1-1 of FIGS. 3A and 3B, the bearing element 4-2 and the eccenter 3*a*-2 are each formed as a round rod and thus from solid material without an axial through opening.

As in the devices 1, 1-1 of FIGS. 2A to 2C and 3A to 3C, the first flattened region 12 extends in the axial direction over the full length of the eccenter 3*a*-2 and thus from the free end face facing in the direction of the housing 2 to the second end face of the eccenter 3*a*-2 at which the eccenter 3*a*-2 merges into the region of the flange 3-2 which closes the housing 2. With the first flattened region 12 of the eccenter 3*a*-2, a flow path is formed between the eccenter 3*a*-2 and the inner side of the inner rotor 7.

In the region of the transition from the eccenter 3*a*-2 to the region of the flange 3-2 closing the housing 2, the flange 3-2 is formed with the groove 13 running in the radial direction, which connects the flow path formed between the eccenter 3a-2 and the inner side of the inner rotor 7 to the suction region 8 of the device 1-2.

In contrast to the devices 1, 1-1 of FIGS. 2A to 2C and 3A to 3C, a second flattened region 14 extends in the axial direction over the full length of the bearing element 4-2 and thus from the first, free end face to a second end face of the bearing element 4-2. At the second end face, the bearing element 4-2 is connected to the eccenter 3a-2, in particular to a free end face of the eccenter 3a-2 facing in the direction of the housing 2. With the second flattened region 14 of the bearing element 4-2, a flow path is ensured between the bearing element 4-2 and the inner side of the outer rotor 6 or the rotor 21 of the electric motor 20.

With the intermediate spaces and the groove 13 which are connected fluidically to one another and formed between the bearing element 4-2 and the inner side of the outer rotor 6 or the rotor 21 of the electric motor 20 by the second flattened region 14 of the bearing element 4-2 and between the eccenter 3a-2 and the inner side of the inner rotor 7 by the first flattened region 12 of the eccenter 3a-2, the flow path is ensured for the leakage flow of the liquid from the motor space 2a to the suction region 8.

The throttle function is provided by adapting the depth of the flattened regions 12, 14 in the radial direction or of the groove 13. With the formation of the flattened regions 12, 14 of the device 1-2 instead of the through opening 4a of the device 1-1, the outer diameter of the eccenter 3a-2 and thus the inner diameter of the inner rotor 7 is less limited than in the device 1-1 with the through opening 4a according to FIG. 3A to 3C. Since in particular the outer diameter of the eccenter 3a-2 of the device 1-2 can have lower values than the device 1-1, the entire flange 3-2, specifically in the region of the bearing element 4-2, can also be formed with a smaller radial extent than the flange 3-1 of the device 1-1.

Figure 5B:
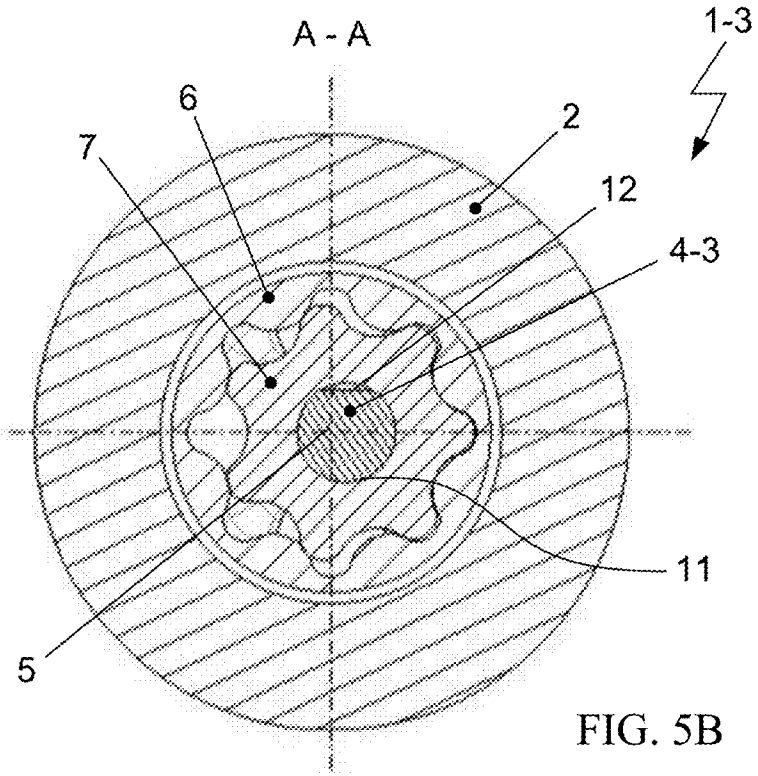
FIGS. 5A and 5B: show a third embodiment of a gerotor pump with the arrangement of the outer rotor on the peg-shaped bearing element formed integrally with the flange, with two mutually opposing and axially offset sections of a flattened region as the device for pressure equalization between the suction region and the motor space, in a sectional diagram from the side and a sectional diagram from above.
Figure 5C:
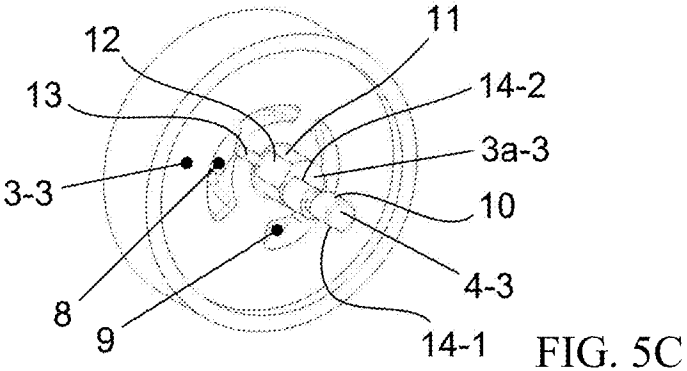
FIG. 5C: shows the flange of the gerotor pump according to FIGS. 5A and 5B in a perspective view.
Figure 5A:
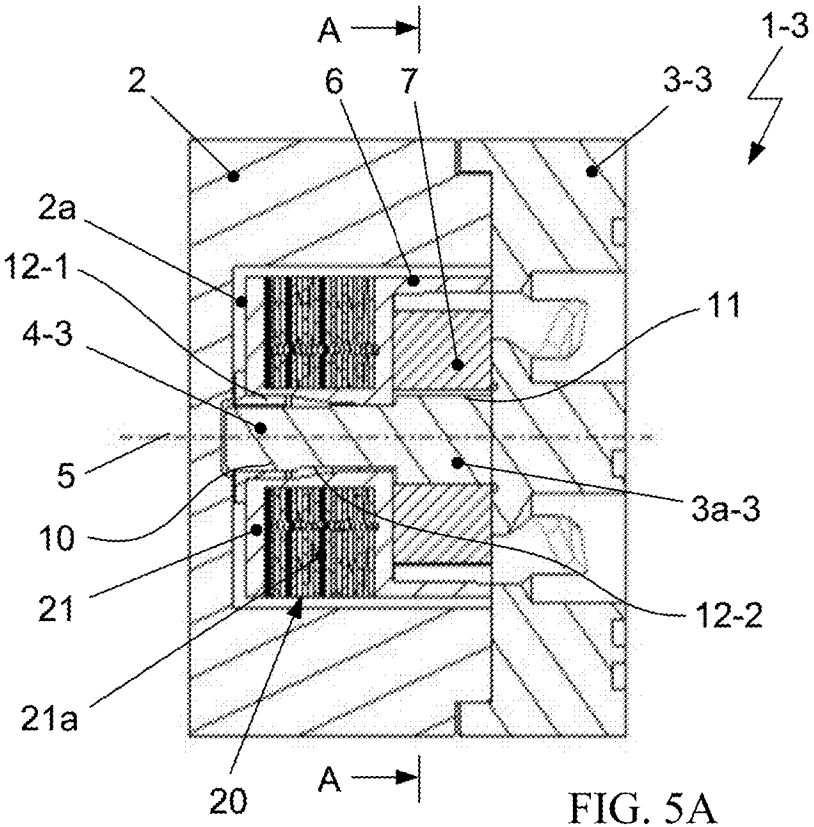

FIGS. 5A and 5B show a device 1-3 for transporting a liquid as a third embodiment of a gerotor pump with the arrangement of the outer rotor 6 on the peg-shaped bearing element 4-3 formed integrally with the flange 3-3, with two mutually opposing and axially offset sections of the second flattened region 14 of a device for pressure equalization between the suction region 8 and the motor space 2a, in a sectional diagram from the side and a sectional diagram from above. FIG. 5C shows the flange 3-3, formed integrally with the bearing element 4-3 for receiving the outer rotor 6, of the device 1-3 according to FIGS. 5A and 5B in a perspective view.

Like components of the devices 1, 1-1, 1-2, 1-3 are again provided with the same reference signs. For the description of the functions of like components, reference is also made to the statements relating to the device 1 according to FIG. 2A to 2C.

An essential difference between the devices 1-2, 1-3 lies in the formation of the bearing element 4-2, 4-3 and thus of the flange 3-2, 3-3 with the eccenter 3a-2, 3a-3 with regard to the device for pressure equalization between the motor space 2a and the suction region 8.

In comparison with the flange 3-2 of the device 1-2 according to FIGS. 4A and 4B, the flange 3-3 of the device 1-3 according to FIGS. 5A and 5B has two sections 14-1, 14-2 of the flattened second region 14 of the cylinder-shaped bearing element 4-3 as the device for pressure equalization. The two sections 14-1, 14-2 of the second flattened region 14 are each arranged on the outer lateral surface of the cylinder with an otherwise circular cross section, opposing one another in the radial direction and offset from one another in the axial direction. The bearing element 4-3 is alternately flattened.

The alternate formation of the first section 14-1 and of the second section 14-2 of the second flattened region 14 on the bearing element 4-3 results in a stable arrangement of the outer rotor 6 or the rotor 21 of the electric motor 20 on the bearing element 4-3. This helps in particular to prevent possible tilting of the outer rotor 6 relative to the bearing element 4-3 and the longitudinal axis 5. The mutually opposing sections 14-1, 14-2 of the second flattened region 14 are designed such that the forces resulting from tilting of the outer rotor 6 are supported, and a section 14-1, 14-2 is provided on the respective opposite side of the tilting, which reduces tilting of the outer rotor 6 of the device 1-3 in comparison with the design of the device 1-2.

LIST OF REFERENCE NUMERALS

1, 1-1, 1-2, 1-3, 1' Device
2 Housing
2a Motor space
3, 3-1, 3-2, 3-3, 3' Flange
3a, 3a-1, 3a-2, 3a-3, 3a' Eccenter
3b' Receiving opening
4, 4-1, 4-2, 4-3 Bearing element
4' Shaft
4a, 4a' Axial through opening
5 Longitudinal axis
6 Outer rotor
7 Inner rotor
8 Suction region
9 Pressure region
10 First bearing surface
11 Second bearing surface
12 First flattened region of second bearing surface 11
13 Groove
14 Second flattened region of first bearing surface 10
14-1 First section of second flattened region 14
14-2 Second section of second flattened region 14
20 Electric motor
21 Rotor
21a Rotor laminations

The invention claimed is:

1. A device for transporting a liquid comprising:

a housing with a flange which enclose a volume, an outer rotor mounted for rotation about a longitudinal axis and an inner rotor of a displacement mechanism, and a rotor of an electric drive which is integrally formed with the outer rotor, wherein the flange is integrally formed with an eccenter for receiving the inner rotor and a pin-shaped bearing element extending in a direction of the longitudinal axis for receiving the outer rotor, wherein the bearing element is formed at least substantially cylinder-shaped with a constant outer diameter in the direction of the longitudinal axis, wherein a fluidic connection of a device for pressure equalization is formed between a motor space as a region of the volume enclosed by the housing with the flange and a suction region, wherein the flange has a flattened region in a region of the eccenter, wherein the flattened region is formed on an outer lateral surface, and wherein a first flattened region is formed extending in an axial direction over a full length of the eccenter, starting from a first, free end face to a second end face of the eccenter.

2. The device according to claim 1, wherein the bearing element is formed protruding from a free end face of the eccenter facing in a direction of the housing.

3. The device according to claim 2, wherein a lateral surface of the bearing element has a first bearing surface for guiding the rotor of the electric drive with the outer rotor.

4. The device according to claim 3, wherein a second bearing surface for guiding the inner rotor driven by the outer rotor is formed on an outside of the eccenter.

5. The device according to claim 1, wherein the flange is formed with an axial through opening at least in a region of the bearing element and of the eccenter.

6. The device according to claim 5, wherein the through opening is formed extending starting from the first, free end face in the axial direction into the bearing element.

7. The device according to claim 6, wherein the through opening is formed oriented coaxially with the longitudinal axis of the device.

8. The device according to claim 1, wherein the flange has a respective flattened region in a region of the bearing element and in the region of the eccenter, wherein the respective flattened region is formed on the outer lateral surface.

9. The device according to claim 1, wherein the flange has a groove running in a radial direction which is formed extending between the first flattened region and the suction region of the device.

10. A method of using the device for transporting the liquid according to claim 1 in a motor vehicle for lubricating and cooling a gear with an oil as the liquid or for cooling a battery or an electric engine.

11. A device for transporting a liquid comprising:

a housing with a flange which enclose a volume, an outer rotor mounted for rotation about a longitudinal axis and an inner rotor of a displacement mechanism, and a rotor of an electric drive which is integrally formed with the outer rotor, wherein the flange is integrally formed with an eccenter for receiving the inner rotor and a pin-shaped bearing element extending in a direction of the longitudinal axis for receiving the outer rotor, wherein the bearing element is formed at least substantially cylinder-shaped with a constant outer diameter in the direction of the longitudinal axis, wherein a fluidic connection of a device for pressure equalization is formed between a motor space as a region of the volume enclosed by the housing with the flange and a suction region, wherein the flange has a respective flattened region in a region of the cylinder-shaped bearing element and in a region of the eccenter, wherein the respective flattened region is formed on an outer lateral surface, and wherein a second flattened region is formed extending in an axial direction, starting from a first, free end face to a second end face of the bearing element.

12. The device according to claim 11, wherein the second flattened region is formed extending in the axial direction continuously over a full length of the bearing element.

13. The device according to claim 11, wherein the second flattened region is formed from at least two sections extending in the axial direction respectively over a partial length of the bearing element.

14. The device according to claim 13, wherein the at least two sections of the second flattened region are formed arranged on the bearing element opposite to one another in the radial direction and offset from one another in the axial direction.

* * * * *